US009682326B2

(12) United States Patent
Burroughs

(10) Patent No.: US 9,682,326 B2
(45) Date of Patent: Jun. 20, 2017

(54) HUMAN FLYING APPARATUS

(71) Applicant: Elizabeth Wales Burroughs, Buda, TX (US)

(72) Inventor: Elizabeth Wales Burroughs, Buda, TX (US)

( * ) Notice: Subject to any disclaimer, the term of this patent is extended or adjusted under 35 U.S.C. 154(b) by 0 days.

(21) Appl. No.: 15/187,359

(22) Filed: Jun. 20, 2016

(65) Prior Publication Data

US 2017/0043265 A1 Feb. 16, 2017

Related U.S. Application Data

(63) Continuation-in-part of application No. 14/790,830, filed on Jul. 2, 2015, now Pat. No. 9,393,496.

(51) Int. Cl.

| | |
|---|---|
| ***A63G 21/20*** | (2006.01) |
| ***B61B 3/00*** | (2006.01) |
| ***B61B 12/00*** | (2006.01) |
| *A63G 31/00* | (2006.01) |

(52) U.S. Cl.

CPC ..... *A63G 21/20* (2013.01); *A63G 31/00* (2013.01); *B61B 3/00* (2013.01); *B61B 12/00* (2013.01); *A63G 2031/002* (2013.01); *A63G 2031/005* (2013.01)

(58) Field of Classification Search

CPC ..... A63G 21/04; A63G 21/20; A63G 31/00; A63G 2031/002; A63G 2031/005; B61B 3/00; B61B 12/00; B64D 23/00

See application file for complete search history.

(56) References Cited

U.S. PATENT DOCUMENTS

| | | | | | |
|---|---|---|---|---|---|
| 3,484,953 | A | * | 12/1969 | Norheim, Jr. | A63G 31/00 434/247 |
| 4,487,410 | A | * | 12/1984 | Sassak | A63G 31/10 434/34 |
| 4,737,107 | A | * | 4/1988 | Bories | B64D 23/00 434/29 |
| 5,094,171 | A | * | 3/1992 | Fujita | A62B 1/10 104/115 |
| 5,224,425 | A | * | 7/1993 | Remington | A63G 21/20 104/113 |
| 5,417,615 | A | * | 5/1995 | Beard | A63G 31/00 187/273 |
| 5,655,909 | A | * | 8/1997 | Kitchen | A63G 31/00 434/43 |

(Continued)

*Primary Examiner* — Zachary Kuhfuss
(74) *Attorney, Agent, or Firm* — Matthew E. Burr

(57) ABSTRACT

The lever, wheel and axle, pulley, wedge, screw, and inclined plane are the six Simple Machines of the Classical era. Over 2000 years ago a man from Syracuse used them to create a way to move water against the pull of gravity. The Archimedes' screw is still a standard for simple efficiency. In homage to those early machines and the dreamers who built them, the Human Flying Apparatus provides a carriage, wheels and an axle, a harness, and a braking and steering system and, in specific embodiments, thrusters, all suspended from a single rail, which allows a human being to soar in simulated flight that is safe, sustained, and suitable for all skill levels.

"For once you have tasted flight, you will walk the Earth with your eyes turned skyward, for there you have been, and there you long to return."
Leonardo Da Vinci

4 Claims, 2 Drawing Sheets

(56) References Cited

U.S. PATENT DOCUMENTS

| | | | | | |
|---|---|---|---|---|---|
| 6,139,439 | A * | 10/2000 | Ure | A63G 31/00 | 434/258 |
| 6,360,669 | B1 * | 3/2002 | Albrich | B61B 3/00 | 104/173.1 |
| 6,929,480 | B2 * | 8/2005 | Lee | A63G 31/00 | 434/247 |
| 7,597,630 | B2 * | 10/2009 | Henry | A63G 3/02 | 104/69 |
| 7,819,664 | B2 * | 10/2010 | Petruk | A63G 31/00 | 434/59 |
| 7,966,941 | B1 * | 6/2011 | Brannan | A63G 21/22 | 104/112 |
| 9,120,023 | B1 * | 9/2015 | Burroughs | A63G 21/20 | |
| 9,393,496 | B2 * | 7/2016 | Burroughs | A63G 21/20 | |
| 2006/0111195 | A1 * | 5/2006 | Henry | A63G 3/02 | 472/128 |
| 2008/0202375 | A1 * | 8/2008 | Quattlebaum | A63G 21/22 | 104/112 |
| 2009/0078148 | A1 * | 3/2009 | Cylvick | A63G 7/00 | 104/53 |
| 2009/0107356 | A1 * | 4/2009 | Kleinberger | B61B 1/00 | 104/27 |
| 2010/0240454 | A1 * | 9/2010 | Xiao | A63G 21/20 | 463/30 |
| 2014/0360398 | A1 * | 12/2014 | Chick | B61B 7/00 | 104/113 |
| 2016/0144869 | A1 * | 5/2016 | Burroughs | A63G 21/20 | 104/53 |
| 2017/0095742 | A1 * | 4/2017 | Boyle | A63G 21/04 | |

* cited by examiner

HUMAN FLYING APPARATUS

CROSS REFERENCE TO RELATED APPLICATIONS

This application relates to, is a continuation in part of, claims the benefit of and priority from, U.S. patent application Ser. No. 14/552,112, filed Nov. 24, 2014, now U.S. Pat. No. 9,120,023 B1, issued Sep. 1, 2015, and co-pending U.S. patent application Ser. No. 14/790,830, filed Jul. 2, 2015, both applications of the same title and by the same inventor, the disclosures of which are incorporated herein by reference as if set forth in full.

TECHNICAL FIELD

This disclosure relates generally to amusement apparatuses, and more particularly to an apparatus for human flight or gliding suitable for use at a theme park, amusement park or other appropriate divertissement.

BACKGROUND

Human beings cannot fly. When we try in sports like sky diving, base-jumping, and bungee-jumping, we risk our lives.

Zip lines attempt to provide soaring, but the participant has little or no control, and the ride is over in just a few seconds. One must apply to several lines in a very large outdoor setting to get any air-time.

Indoor skydiving involves balancing on a column of super accelerated air that is uncomfortable at best. Again the ride only lasts a few seconds, and is not for all skill levels.

The aforementioned efforts to simulate a flying experience for humans are evidence of an unmet demand for a true experience of flying that is safe, comfortable, and that lasts a satisfying amount of time.

SUMMARY

A single rail system, suspended from the ceiling of a large warehouse, for example, shaped like an inverted roller coaster. Alternatively, the rail system is suspended from support members that extend upward from the ground. Integrated into the rail system is a free-moving, gravity driven wheel carriage which is attached to a bungee cord approximately 10 feet long, which is in turn attached to a soaring harness that a person wears to fly through this inverted course. The harness is equipped with a braking and steering system. It is essentially safe, indoor, flying for all ages and athletic abilities.

The apparatus of the present disclosure allows the participant to step off a platform into thin air, yet stay connected to the undulating course of the rail system. The flyer maintains a constant distance from the rail system, with some give in the bungee cord, and uses the harness and handlebar steering and braking system to glide and soar like a bird. It allows for courses that could last for many minutes at a time depending on the grade and height of the course. There is also the potential to run multiple flyers on multiple courses at staggered start times.

BRIEF DESCRIPTION OF THE DRAWINGS

For a more complete understanding of the present disclosure, and the advantages thereof, reference is now made to the following descriptions taken in conjunction with the accompanying drawing, in which.

NOTATION AND NOMENCLATURE

Certain terms are used throughout the following description and claims to refer to particular system components. As one skilled in the art will appreciate, different companies may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
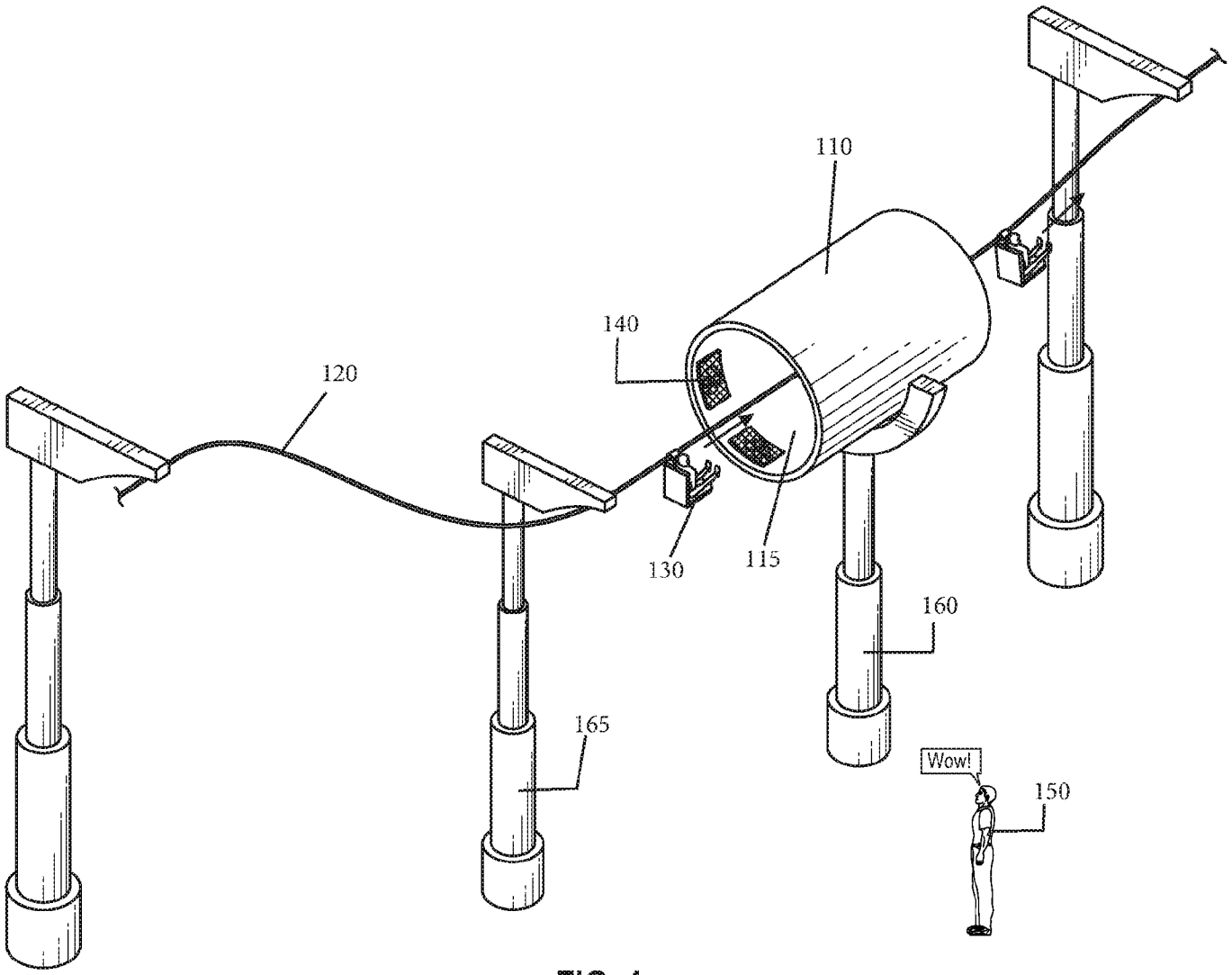
FIG. 1 is perspective view of an exemplary specific embodiment of a human flying apparatus of the present disclosure.

FIG. 1 of the drawings is perspective view of an exemplary specific embodiment of a human flying apparatus of the present disclosure. The specific exemplary embodiment incorporates a so-called Super-Accelerated Air Release Chamber ("SAARCH") 110 into the human flying apparatus course. The rail 120, with flyer 130 suspended, as described in the related patent and patent application, enters the SAARCH 110 which blasts the flyer 130 with jets from high-powered fans 140 that propel the flyer 130 out into the course again. The SAARCH 110 gives the flyer 130 a boost of acceleration from the air jets to make for a more exhilarating experience as witnessed by human observer 150.

The SAARCH 110 passageway 115 is held aloft by towers 160 similar to the towers 165 which suspend the rail 120. It is preferably configured in true tunnel form, although other suitable forms of the passageway may be evident to those of ordinary skill in the art and are contemplated by the present disclosure. The rail 120 is able to pass through the passageway 115 due to the support it receives from towers 160 on both ends. The SAARCH 110 air supply can be powered through ground-based power sources by power conduits run upwards along or through one or more of the support towers 160.

Figure 2:
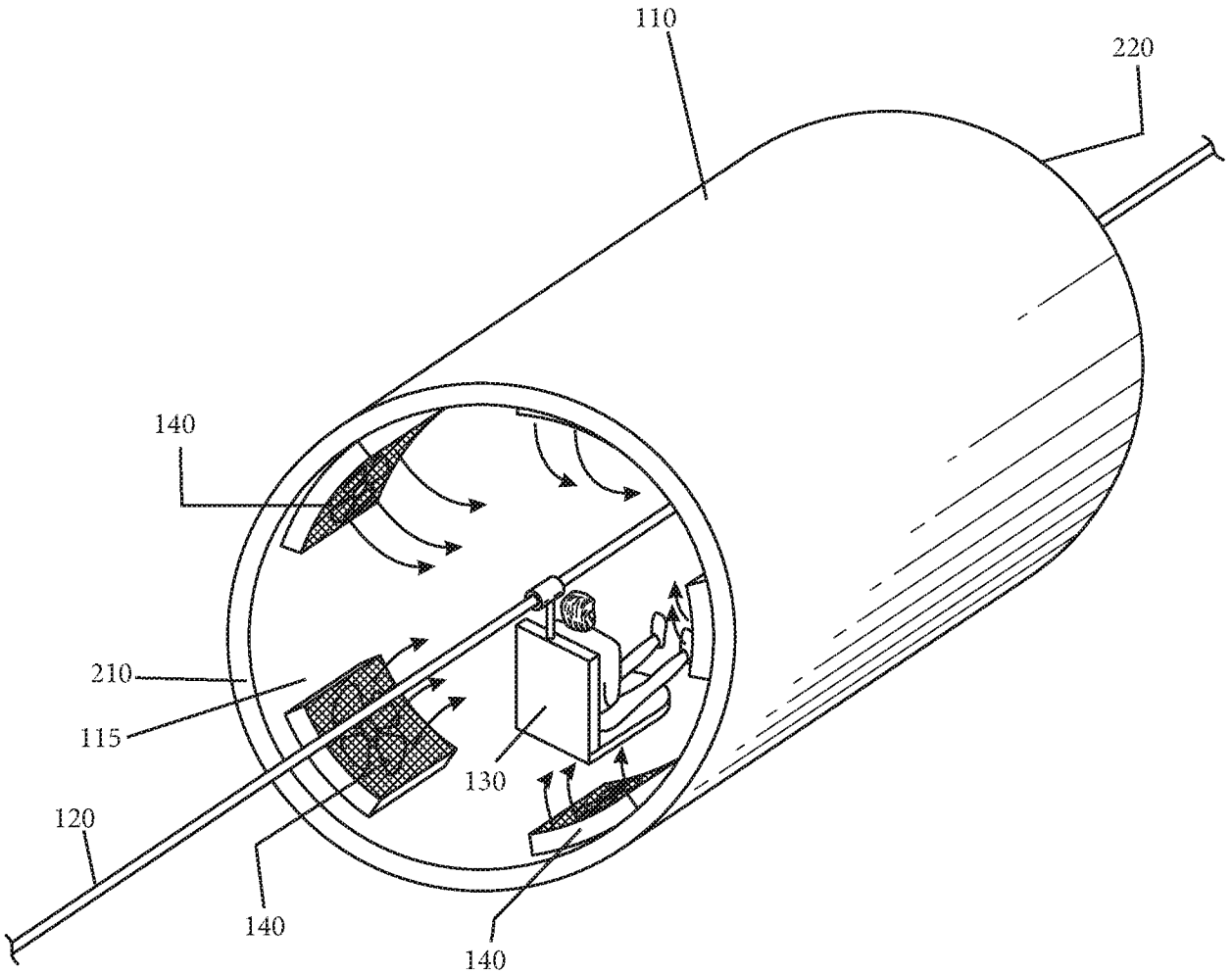
FIG. 2 is a front view of an interior detail of the exemplary specific embodiment of FIG. 1.

FIG. 2 of the drawings is a front view of an interior detail of the exemplary specific embodiment of FIG. 1. One or more sources of directional propelled air, such as fans 140 or air jets, for example, are provided at or near the proximate opening 210 of the passageway 115. In specific alternative embodiments, additional propelled air sources may be provided spaced out along the interior space of the SAARCH 110 passageway 115. The propelled air (indicated by the arrows extending from fans 140) from the sources moves predominately in a direction from the proximal opening 210 of the passageway 115 toward the distal exit of the passageway, analogous to a wind tunnel, and pushes the flyer in the passageway, providing an impelling force on the flyer to accelerate the flyer out of the distal exit 220 of the passageway 115.

Many modifications and other embodiments of the system and apparatus described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus comprising:

a. a support structure;

b. a rail attached to the support structure and having an elevated takeoff terminus and a landing terminus to provide a path of travel from the takeoff terminus to the landing terminus;

c. a carriage moveably coupled to the rail;

d. a passageway attached to the support structure such that the passageway extends along a portion of the rail and the rail passes through the passageway;

e. one or more sources of directional air disposed within the passageway;

f. one or more power sources that provide power to the one or more sources of directional air;

g. a user-operated means for braking the carriage;

h. a brake conduit depending from the carriage and connected to the user-operated means for braking the carriage;

i. a harness for securing a user; and j. an elastic connector connecting the brake conduit to the harness, whereby a user secured in the harness effectuates a descent from the takeoff terminus to the landing terminus and is accelerated through the passageway by the directional air.

2. The apparatus of claim 1, wherein the passageway is a wind tunnel.

3. The apparatus of claim 1, wherein at least one of the one or more sources of directional air is a jet.

4. The apparatus of claim 1, wherein at least one of the one or more sources of directional air is a fan.

* * * * *